United States Patent [19]

Johnson

[11] 4,359,964

[45] Nov. 23, 1982

[54] AIR KNIFE COATER WITH PIVOTED LIP

[75] Inventor: Richard E. Johnson, Beloit, Wis.

[73] Assignee: Beloit Corporation, Beloit, Wis.

[21] Appl. No.: 265,634

[22] Filed: May 20, 1981

[51] Int. Cl.[3] ..... B05C 11/06

[52] U.S. Cl. ..... 118/63; 118/249

[58] Field of Search ..... 118/63, 249; 427/348, 427/349; 15/306 A, 415

[56] References Cited

U.S. PATENT DOCUMENTS

| | | | |
|---|---|---|---|
| 2,940,418 | 6/1960 | Penrod et al. | 118/63 |
| 2,981,223 | 4/1961 | Olszowka | 118/63 |
| 3,202,536 | 8/1965 | Brezenski | 118/63 X |
| 3,314,163 | 4/1967 | Kohler | 118/63 X |
| 3,336,899 | 8/1967 | Mahoney | 118/63 |
| 3,829,927 | 8/1974 | Boyland | 15/415 X |
| 4,005,676 | 2/1977 | Phillips | 118/63 |
| 4,106,429 | 8/1978 | Phillips | 118/63 |
| 4,141,789 | 2/1979 | Justus | 162/272 |

*Primary Examiner*—John P. McIntosh

*Attorney, Agent, or Firm*—Hill, Van Santen, Steadman, Chiara & Simpson

[57] ABSTRACT

An air knife coater mechanism such as for coating a traveling web of paper including a backup over which the web travels with means for applying a coating to the web surface and an air knife for smoothing the coating while the web is supported on the backup roll with the air knife having first and second lips with the upper lip pivotally mounted for movement away from the lower lip to an open position for access to the gap and cleaning the distal edge of the upper lip and the operating mechanism in the form of an adjustable toggle linkage.

6 Claims, 1 Drawing Figure

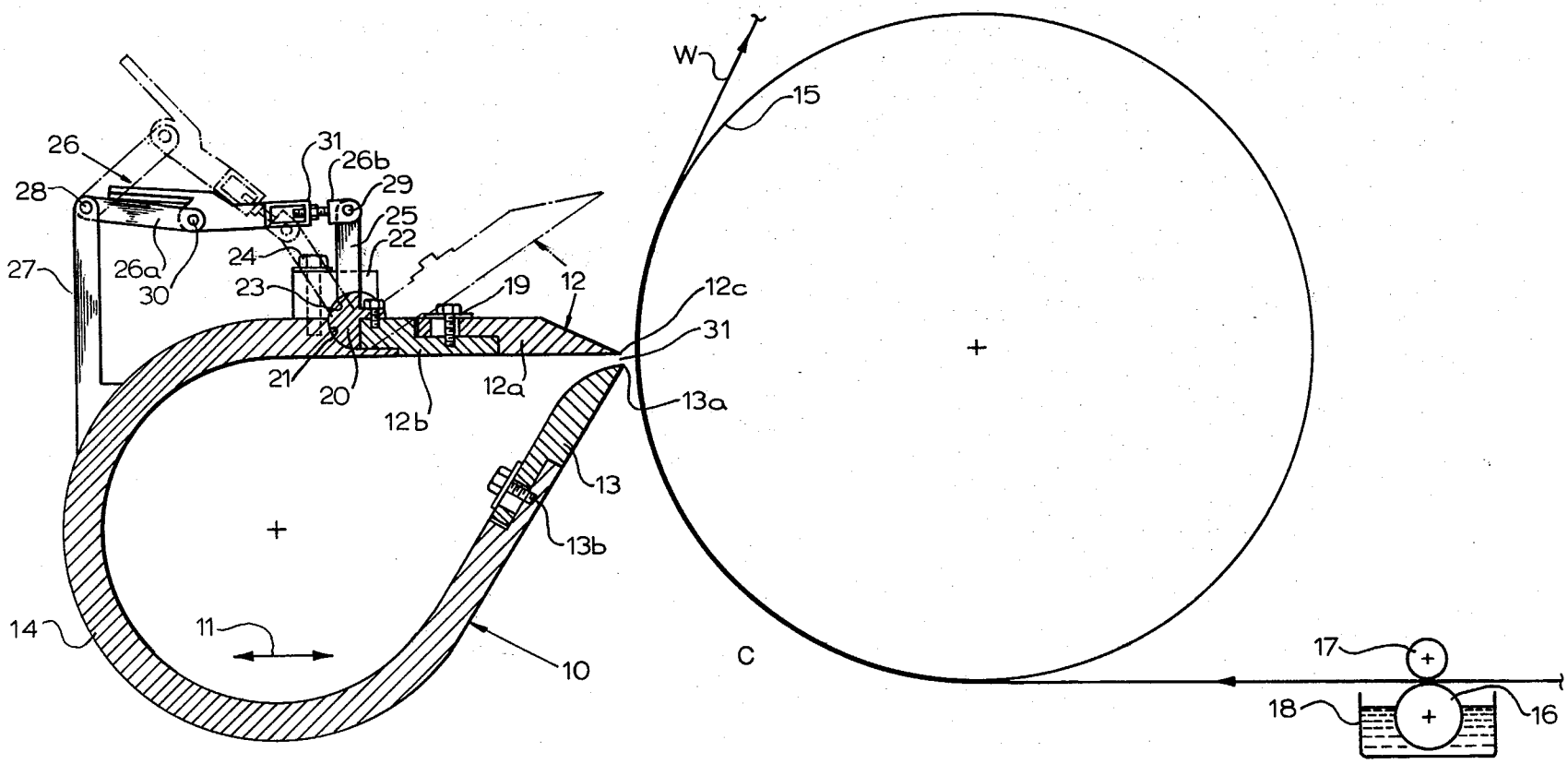
10
11
12
12a
12b
12c
13
13a
13b
14
15
16
17
18
19
20
21
22
23
24
25
26
26a
26b
27
28
29
30
31
W
C

AIR KNIFE COATER WITH PIVOTED LIP

BACKGROUND OF THE INVENTION

The present invention relates to improvements in air knife coaters for paper machines.

In an air knife coater for coating a traveling web of paper, the web is trained over a backup roll and coating is applied to the other surface of the web by various means such as by a coating roll. The air knife directs a thin high velocity sheet of air against the freshly applied coating on the web to either smooth the coating, and in some instances to both smooth the coating and doctor off excess coating. In coating, it is very important that the gap between the lips of the air knife orifice be accurately spaced from each other so that the flow of air forming the air knife be uniformly applied across the width of the machine. Since the gap is normally quite narrow (i.e., about 0.030"), it is important that the lips be firmly supported and be maintained clean.

For cleaning operation, the air knife assembly can be moved away from its operating position, but it has been found to be highly advantageous if the lips can be separated for cleaning the distal edge of each of the lips and for access to the slot between the lips. Such separation for cleaning must be followed by the lips again being moved back together to an accurate position so that the gap is once again accurately defined and maintained uniform across the machine.

In addition to being able to separate the lips for cleaning purposes, it is helpful to be able to separate the lips to have access to their inner surfaces for inspection. Experience in operation proves that conventional cleaning methods such as inserting a blade type object between the lips does not always clean the surfaces. With this type of cleaning, there is no way to totally inspect the surfaces to make sure foreign material is dislodged. Thus, if a cleaning operation is accomplished by the use of a blade type cleaner, and the air knife head is again put into operation, foreign material which is not removed but merely dislodged may affect the gap and the operator does not know this until operation is again begun, and the defect is detected by defects in the surface of the coat of paper.

It is accordingly an object of the present invention to provide an improved air knife coater which makes it possible to thoroughly clean the distal edges of the lips and the surfaces between the lips which form the gap in such a manner that cleanliness is assured, and the operator does not have to restart the machine to see if foreign materials have been fully dislodged and cleaned.

It is another object of the invention to provide an improved air knife coater wherein the lips can be separated quickly for inspection, and also for cleaning and wherein the lips can be quickly again closed to their predetermined accurate gap for returning them to operation.

A feature of the invention is to pivotally support one of the lips relative to the other, preferably the upper lip, and the pivotal support is constructed so as to supply rigidity to the upper lip maintaining it in proper relationship to the lower lip. In a preferred arrangement, the upper lip is divided into two parts with the lower portion narrowing down to an orifice in the usual manner. The lower portion is supported from the upper section with cams and locking screws so that the tip of the lip can be adjusted relative to the other lip in the usual manner. The upper portion of the lip is fitted with a rod the full width of the machine and held in place by clamps to form a hinge. The hinged lip is opened or held in operating position by toggle clamps which are adjustable.

Other objects, advantages and features will become more apparent with the teaching of the principles of the present invention in connection with the disclosure of the preferred embodiments in the specification, claims and drawings, in which:

DRAWING

The single FIGURE of the drawing illustrates a coating apparatus constructed and operating in accordance with the principles of the present invention.

DESCRIPTION OF THE PREFERRED EMBODIMENTS

As illustrated in the drawing, an air knife doctor back 10 is provided with a chamber therein supplied with pressurized air for blowing air out through a gap or slot formed between a first upper lip 12 and a second lower lip 13. The lips are supported on the rigid back 14 in position for directing a jet of air toward the oncoming web W which has a coating C on its surface. The web is supported on a rotating roll 15 and coating is applied in advance of the air knife by a suitable means such as a coating roll 16. The coating roll carries coating onto the surface of the web by being partially submerged in a coating bath in a container 18, and a roll 17 provides a nip with the coating roll for applying the coating in a thin layer to the surface of the traveling web. The back 14 and its parts is shown disproportionately large relative to the roll 15 for the purpose of illustrating details of the parts.

The air knife coater is shown in operating position, but will be supported by means which permit it to be moved away from its operative position as shown schematically by the arrowed lines 11. Various types of mechanism may be provided supporting the back 14 at its ends permitting movement into the operating position as shown in the drawing or away from the operating position when the machine is to be serviced, cleaned or rethreaded.

The air slot is formed between the distal edges **12*c* and 13*a* of the lips. The lower lip is rigidly supported on the back 14 and may be adjusted to an exact position by bolts 13*b* which permit the lower lip 13** to be set rigidly in its adjusted position.

The upper lip has an outer lip portion **12*a* and a supporting portion 12*b*. The outer lip portion may be carried on the supporting portion 12*b* by bolts and cams shown somewhat schematically at 19 which permit rigidly mounting the lower portion 12*a* and adjusting it along its length so as to maintain the distal edge 12*c* a uniform distance from the surface of the roll 15. Such cam mechanism 19** need not be described in detail, but can be of the type illustrated in U.S. Pat. No. 4,106,429, Phillips.

A feature of the invention provides for movement of the upper lip assembly 12 from the operative position shown in the solid lines in the drawings to the dotted line position which is the open position for inspection and/or for cleaning.

The base edge of the upper portion **12*b* of the upper lip is fitted with a cylindrical rod 20 which seats in a cylindrical socket 21 in the back 14. The cylindrical socket for the rod 20** is completed by a series of clamps 22 which have their cylindrical surfaces 23 and are mounted on the back by bolts 24. The rod 20 seated in its socket formed by surfaces 21 and 23 forms a rigid aligning support for the upper lip 12 holding it parallel throughout its entire length across the width of the machine so as to aid in maintaining the gap between the two lips of uniform width.

The lip is maintained in its operative solid line position by an arm 25 connected to the rod 20. While a single arm is shown, it is understood that a plurality of arms may be arranged along the length of the rod. The rod is forcibly held in its position as shown by a toggle linkage 26. The toggle linkage includes a link 26*a* and a link 26*b* with the links pivoted to each other at 30. The link 26*a* is pivotally mounted at 28 on a support 27 which is part of the doctor back 14. The link 26*b* is pivoted at 29 to the lip arm 25. Link 26*b* has a toggle 31 in its length so as to be able to adjustably control its length and thereby control the size of the gap or slot 31. It will be apparent that if a series of arms 25 are arranged along the length of the rod, the individual toggles can be lengthened or shortened to help insure uniformity of the gap 31, that is, the spacing between the upper lip 12 and the lower lip 13.

For inspection of the space between the lips, the toggle linkage 26 is pulled upward to its broken dotted line position as shown in the drawing. This will pivot the upper lip up to its dotted line position affording full access to the gap between the lips. This permits cleaning the distal edge of the lips and inspection of the space between them. This arrangement permits for rapid opening of the lips for periodic inspection, and inspection can easily be attained without necessitating cleaning. However, if cleaning appeared necessary, it can be accomplished and the lips rapidly moved to their operative position by moving the top lip down to the solid line position by pushing the toggle to the rigid position. The toggle is provided with a stop 32 which limits its over-center lowermost position to lock the lip in the fixed chosen location.

In operation, the mechanism will direct a stream of air through the gap 31 against the oncoming traveling web until such time as the operator wishes to inspect or to clean the space between the lips. The back is then moved a small distance away from the roll, and the toggle lifted to the upper dotted line position shown in FIG. 1 which open the upper lip or moves it away. The amount of pivotal movement given to the upper lip is preferably in the range of 30° to 90°. With the upper lip raised, the operator can immediately check whether foreign elements or dried coating have collected on the distal edges of the lips or on the surfaces facing each other in the slot, and if so, the facing surfaces of the lips can be quickly cleaned. The toggle can then be returned to its solid line position which brings the upper lip back to the exact predetermined relationship with the lower lip for resuming operation. Adjustment of the turnbuckles 31 for the various toggles will adjust the width of the gap along the length of the lip, that is, across the width of the machine.

Thus, I have provided an improved air knife coating mechanism which achieves advantages not possible with structures heretofore available in the art. An improved coating operation and an improved product will result because improved accuracy of the air gap is achieved and a uniformity is achieved not marred by partially or improperly cleaned surfaces between the lips.

I claim as my invention:

1. An air knife coater for coating the surface of a traveling web, comprising in combination:
- a web supporting carrier over which a traveling web is trained to be supported through a coating zone;
- means for applying coating to the web;
- an air knife for treating the coating on the web having first and second lips defining an air slot therebetween directed at the web after a layer of coating has been applied by said coating means;
- a pivotal support for the first lip mounting the lip for movement between a first position when a precise slot is defined with the other lip and a second position pivoted away from the second lip for cleaning off the distal edge of the first lip and for access to the slot between the lips; said support including a cylindrically shaped base for the first lip extending parallel to the lip and a receiving clamp having a cylindrically shaped socket for receiving the cylinder and providing pivotal support; and
- an operating arm connected to the first lip with said arm providing force applying means for moving the lip between said first and second positions and being adjustable for controlling the width of said air slot.

2. An air knife coater for coating the surface of a traveling web constructed in accordance with claim 1:
- said operating arm including a toggle mechanism having first and second toggle links with said links in substantial alignment for the first position of the first lip and with said links forming an angle with each other for said second position.

3. An air knife coater for coating the surface of a traveling web constructed in accordance with claim 2:
- wherein one of said links is adjustable in length.

4. An air knife coater for coating the surface of a traveling web constructed in accordance with claim 2:
- wherein the second position of the lip forms an angle with the first position in the range of 45° to 90°.

5. An air knife coater for coating the surface of a traveling web comprising in combination;
- a web supporting carrier roll over which a traveling web is trained to be supported in travel through a coating zone;
- a coating applicator roll positioned in advance of the coating zone for applying a layer of coating to the outer surface of a web;
- an air knife positioned for directing a flow of smoothing air against the traveling web as it is supported on the roll;
- said air knife including a doctor back supporting first and second air knife lips thereon with the second lip being rigidly supported and the first lip pivotally supported thereon;
- means for moving the doctor back laterally relative to the support roll;
- a pivotal support for the first lip including an arm movable from a first position wherein the first lip defines a precise slot with the second lip and a second position where the first lip is pivoted away from the second lip;
- an operating toggle linkage for moving the lip between said first and second positions;
- and means for adjusting the first position of the first lip for controlling the width of the slot.

6. An air knife coater for coating the surface of a traveling web constructed in accordance with claim 5:
- wherein said toggle linkage includes an adjustable arm for adjusting the width of the air slot.

* * * * *